United States Patent [19]

Scheffer

[11] Patent Number: 4,703,715

[45] Date of Patent: Nov. 3, 1987

[54] METHOD AND APPARATUS FOR PREVENTING SLINGING OF LIQUID IN A LIQUID APPLICATOR MACHINE

[76] Inventor: Bruce A. Scheffer, 504 Wexford Rd., Valparaiso, Ind. 46383

[21] Appl. No.: 868,774

[22] Filed: May 28, 1986

[51] Int. Cl.[4] ..... B05C 1/00; B05C 1/06; B05C 1/08

[52] U.S. Cl. ..... 118/203; 118/212; 118/249; 118/262

[58] Field of Search ..... 118/244, 248–251, 118/419, 203, 212, 262; 427/359, 361, 365, 366, 428

[56] References Cited

U.S. PATENT DOCUMENTS 4,253,903 3/1981 McDonald ..... 128/203 X 4,480,582 11/1984 Schaefer ..... 118/203 X

*Primary Examiner*—Michael R. Lusignan

*Attorney, Agent, or Firm*—Welsh & Katz, Ltd.

[57] ABSTRACT

A liquid applicator machine of the type operative to apply a liquid such as glue to a moving paper web or the like through a high speed transfer roll which receives a metered film layer of liquid thereon from a pan roller. A static ring is supported in coaxial predetermined spaced relation to each end edge surface of the transfer roll and has an outer annular surface overlapped by the pan roller such that liquid carried upwardly by the end surfaces of the pan roller engages the static ring and is prevented from accumulating at the end edges of the transfer roll and being slung therefrom during high speed rotation of the transfer roll. The invention finds application with full width and segmented transfer rolls to prevent fluid slinging therefrom.

24 Claims, 6 Drawing Figures

22
12
20
10
70b
68
80a
18
82a
64
72
82
72
74a
66b
70a
78
74
36
66
66a
40
16
28
38
46a
46b
34
44
58
48
52
56

METHOD AND APPARATUS FOR PREVENTING SLINGING OF LIQUID IN A LIQUID APPLICATOR MACHINE

BACKGROUND OF THE INVENTION

The present invention relates generally to machines for applying a liquid, such as glue or other liquid substances, to a moving web, and more particularly to a novel method and apparatus for preventing slinging of liquid from high speed rotating rolls within a liquid applicator machine or the like.

It is a conventional practice in the art of web printing presses and the like, to pass a web of material, such as paper, through a machine operative to selectively apply a liquid glue and/or other liquid substances to the web as it is passed through the liquid applying machine from, for example, a printing press. Such machines, typically termed pattern gluers, generally employ a plurality of cooperating cylindrical rollers to transfer liquid from a liquid source to the moving web, the rolls or cylinders conventionally including a pan roller, a transfer roll or cylinder, a plate cylinder and an impression cylinder. The rolls and cylinders are generally supported for rotation about horizontal axes, with the pan roller being partially submerged within a liquid reservoir and rotated at a relatively low speed so as to transfer liquid from the reservoir to the transfer roll which is rotated at a relatively high speed matching the surface speed of the web material passing through the liquid applicator machine. The pan and transfer rolls are maintained in predetermined spatial and rotational speed relation such that the liquid carried on the pan roll creates a metered liquid layer or film on the transfer roll. The liquid layer or film formed on the transfer roll is then transferred to an exposed pattern surface of a closed cell rubber pad carried on the rotating plate cylinder so as to selectively apply the liquid to the moving web of paper material. A fourth roll or cylinder, generally termed the impression cylinder, is located on the opposite side of the moving web from the plate cylinder and serves to maintain the moving web material stable against the plate cylinder and thereby assist in transferring the liquid film from the pattern pad on the plate cylinder to the moving web material. Such liquid applicator machines are of generally two types, one of which is operative to apply a patterned glue or other liquid substances to the lower surface of a moving web material passing through the machine and the other of which is operative to apply glue or other liquid substances to the upper surface of the web material.

A significant problem which exists with known liquid applicator machines, and particularly applicator machines of the aforementioned type employing a relatively low speed pan roll and a relatively high speed transfer roll cooperative to effect transfer of a metered layer of liquid from the pan roll to the transfer roll, is that the liquid picked up by both the outer cylindrical surface and end surfaces of the pan roll from the liquid reservoir is generally transferred to the transfer roll in a manner which causes liquid accumulation at the opposite end edges and corresponding end surfaces of the transfer roll from which the accumulated liquid is slung off. Such slinging of liquid from the transfer roll may necessitate slow-down of the machine as well as cause damage to the moving web material with resulting potential for breakage. This problem has been particularly acute where the pan roll has a shorter length than the transfer roll such that liquid carried upwardly to the transfer roll by the end surfaces of the pan roll tends to be deposited onto the adjacent outer peripheral surface areas of the transfer roll and migrate to the corresponding outer end edges and around onto the associated end surfaces of the transfer roll from which the liquid is slung off by the inertia of high-speed rotation. A similar problem exists where the pan roll is of substantially the same length as the transfer roll in that liquid carried upwardly on the end surfaces of the pan roll is generally transferred directly onto the corresponding end surfaces of the transfer roll from which the liquid is slung outwardly by the centrifugal forces created by high-speed rotation of the transfer roll.

One attempt to eliminate the aforedescribed problem of liquid slinging within liquid applicator machines includes positioning a stationary scraper or wiper type device adjacent each of the opposite end edges of the transfer roll so as to scrape off the accumulated liquid transferred onto the transfer roll from the pan roll. This technique is of limited value in that many viscous liquids, such as glue and the like, accumulate to a point where continued build-up of liquid on the scraper blades causes the liquid to climb over the scraper blades onto the corresponding outer end surfaces of the high speed transfer roll from which the liquid is flung outwardly to thereby create the very problem the scraper or wiper blades were intended to cure. In either event, the scraper or wiper blades must be continually removed and cleaned, thereby necessitating down time of the machine with attendant increased maintenance costs.

Similar problems exist in liquid applicators of the type adapted to apply a plurality of different liquids to a moving web. Such machines, generally termed segmented applicators, employ a transfer roll having a plurality of axially spaced discreet cylindrical segments each of which cooperates with an associated pan roll and liquid reservoir to effect transfer of liquid from the reservoir to the corresponding transfer roll segment from which the liquid is transferred to the moving web material through a plate cylinder in a conventional manner. The problem of liquid slinging from the opposite ends of the various transfer roll segments is particularly troublesome in this type of liquid applicator machine because the slung liquid droplets cause contamination by intermixing with the different liquids in other liquid reservoirs. Thus, significant problems exist in the known liquid applicator machines as a result of liquid slinging from the high speed transfer rolls. The present invention addresses these problems.

SUMMARY OF THE INVENTION

One of the primary objects of the present invention is to provide a novel method and apparatus for preventing slinging of liquid in a liquid applicator machine such as employed on web printing presses and the like.

Another object of the present invention is to provide a novel method and apparatus for preventing slinging of liquid in a liquid applicator machine of the type employing at least one pan roll operative to transfer liquid from a liquid reservoir to a transfer roll in a manner to create a metered layer of liquid on the transfer roll, the method and apparatus of the invention being operative to prevent the accumulation of liquid on the opposite end edge surfaces of the transfer roll and thereby prevent slinging of liquid from the opposite end surfaces of the transfer roll.

A more particular object of the present invention is to provide a novel method and apparatus for preventing slinging of liquid from a liquid applicator machine of the aforementioned type wherein a static ring member is supported in coaxial relation with and closely spaced from each of the opposite ends of the transfer roll and wherein the pan roll is made of a length greater than the transfer roll so as to extend beyond each end of the transfer roll and partially overlap the corresponding static rings in closely spaced relation therewith to prevent the accumulation of liquid at the opposite end edge of the high speed transfer roll.

A feature of the present invention lies in the provision of a static ring and holder assembly which enables exact positioning of a static ring relative to an end edge surface of a high speed transfer roll, the ring having an annular outer peripheral surface of similar diameter to the associated cylindrical transfer roll and having a planar side surface of limited surface area such that when spaced from an end surface of the transfer roll a distance sufficient to prevent entry of liquid between the static ring and corresponding end surface of the transfer roll, minimum frictional heat is generated.

Still another feature of the present invention lies in the provision of a static ring and holder assembly having a pair of static rings which may be employed with opposing end surfaces of discreet axially spaced cylindrical roll segments formed on a high speed transfer roll such that the static rings cooperate with both the transfer roll segments and associated discrete pan rollers to prevent accumulation of liquid on the end edges of the transfer roll segments and thereby eliminate slinging of liquid from the transfer roll with resulting contamination of the different liquids during application to a moving web or the like.

A further feature of the static ring and holder assembly in accordance with the invention lies in the ability to mount the holder and a pair of static rings circumferentially about a reduced diameter portion of a transfer roll between oppositely facing end surfaces of larger diameter cylindrical segments formed on the transfer roll, and wherein the static rings may be spaced predetermined distances from the opposed end surfaces of the cylindrical transfer roll segments.

Further objects and advantages of the present invention, together with the organization and manner of operation thereof, will become apparent from the following detailed description of the invention when taken in conjunction with the accompanying drawings wherein like reference numerals designate like elements throughout the several views.

DETAILED DESCRIPTION OF PREFERRED EMBODIMENT

Figure 1:
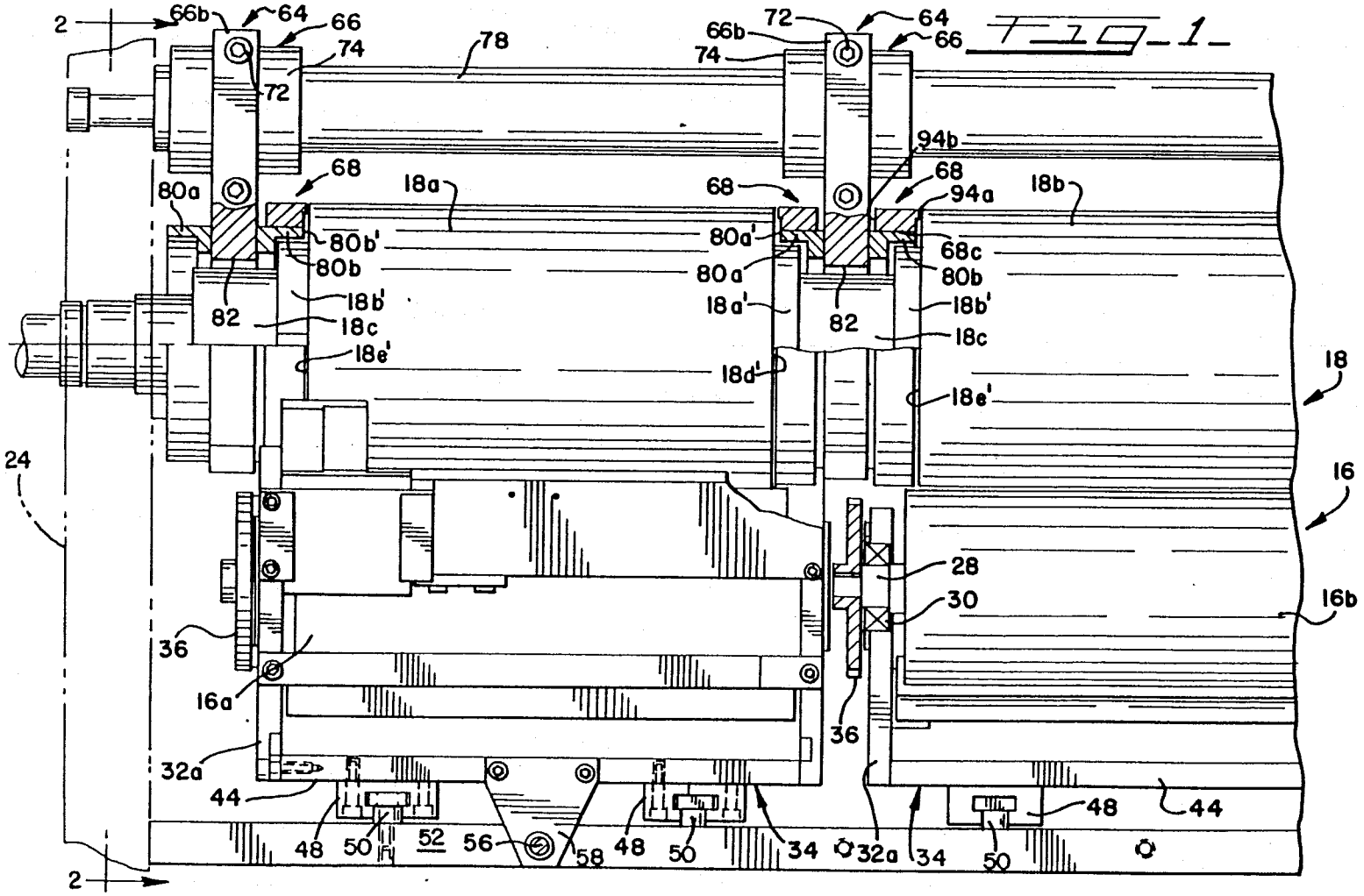
FIG. 1 is a fragmentary elevational view of a machine for applying liquid to a moving web and which employs static ring assemblies in accordance with the present invention, the static ring assemblies and associated support rod being rotated from their normal positions shown in FIG. 2, and with portions broken away for purpose of clarity.
Figure 2:
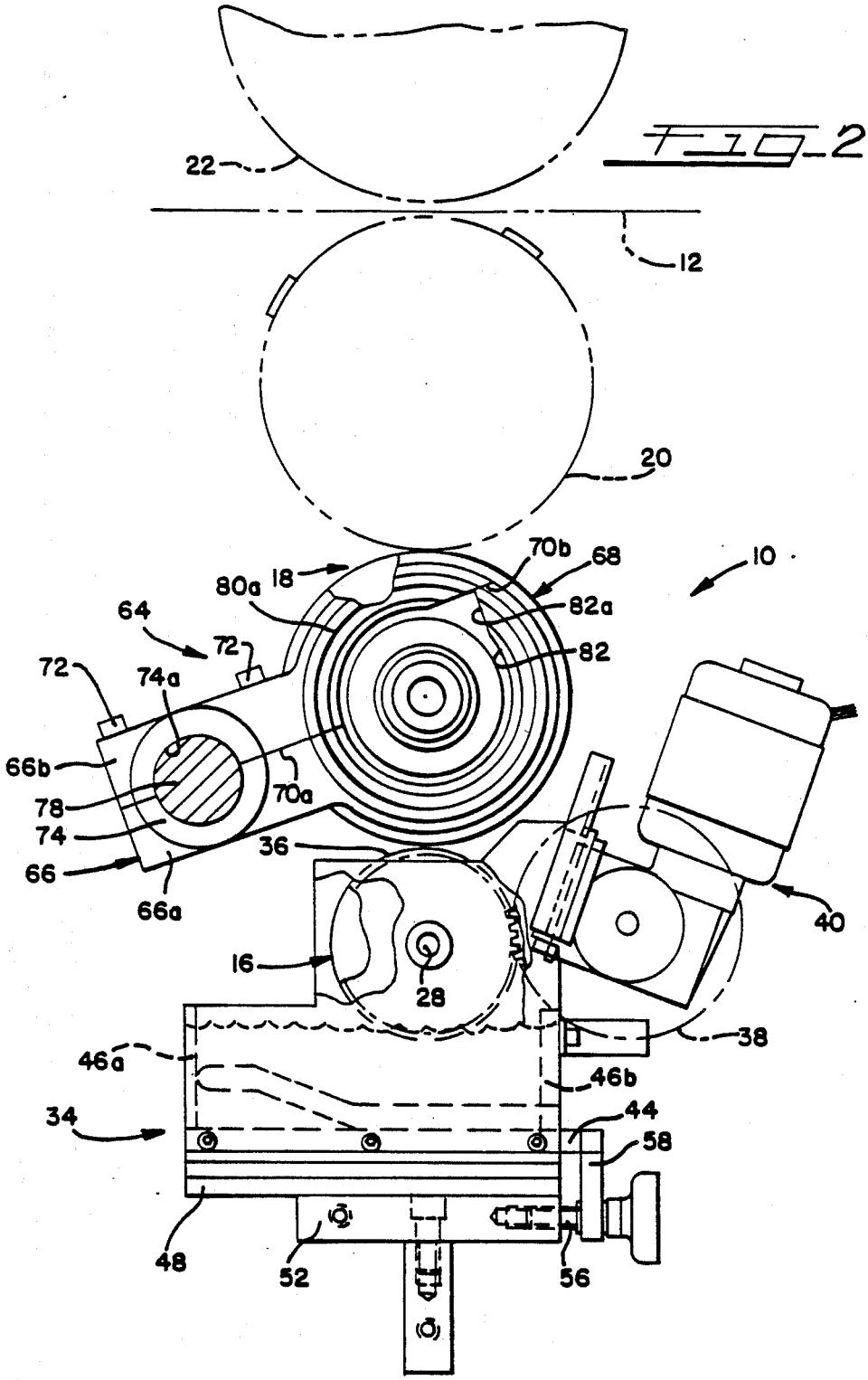
FIG. 2 is a fragmentary transverse sectional view taken substantially along line 2—2 of FIG. 1 but further showing a plate cylinder, web material and impression cylinder in phantom.

Referring now to the drawings, the present invention is illustrated, by way of example, as being employed in a liquid applicator machine a fragmentary portion of which is illustrated in FIGS. 1 and 2 and is indicated generally at 10. The liquid applicator machine 10 is of the type operative to transfer one or more liquid materials, such as different types of glue, microfragrances and/or rub-off spot material, to a moving web of paper 12 or similar material which is generally passed through the liquid applicator from a printing press or the like. The liquid applicator machine illustrated in FIGS. 1 and 2 is a four-cylinder type machine which employs a pan roller or roll 16, a transfer roll or cylinder 18, a plate cylinder 20 and an impression cylinder 22, the various rolls and cylinders having their rotational axes disposed in horizontal generally vertically overlying relation with the paper web 12 passing between the plate cylinder 20 and the impression cylinder 22 in a conventional manner.

In the illustrated embodiment, the transfer roll or cylinder 18, the plate cylinder 20 and the impression cylinder 22 are supported for rotation about their longitudinal axes by generally upstanding frame plates, one of which is indicated at 24 in FIG. 1, of a machine frame structure. The transfer roll 18 may comprise a uniform diameter cylindrical roll extending substantially the full width of the applicator machine, or may comprise a unitary roll having a plurality of discrete cylindrical segments such as indicated at **18*a* and 18*b* in the embodiment of FIG. 1. The transfer roll 18, whether of the uniform diameter cylinder type or of the segmental cylinder type, is conventionally made from a suitable steel material and is operatively associated with rotational drive means (not shown) operative to effect relatively high speed rotation of the transfer roll so as to establish a surface speed substantially equal to the linear speed of the web material 12** passing through the liquid applicator machine. The rotational speed of the transfer roll may thus approach approximately 1000 rpm or greater.

Each discrete cylindrical segmental portion **18*a* and 18*b* of the transfer roll 18 is adapted to receive a metered layer of liquid on its outer peripheral surface from a corresponding pan roller, indicated at 16*a* and 16*b*, respectively, in FIG. 1. To this end, each of the pan rollers 16*a* and 16*b* is mounted independently for movement relative to its corresponding transfer roll segment so as to enable a predetermined spatial relation to be established between the pan roller and its corresponding transfer roll. Each pan roller is also adapted to be rotated about its longitudinal axis at a selected rotational speed to provide optimum operating conditions for different fluids as may be applied to the paper web 12. In the illustrated embodiment, each of the pan rollers 16***a* and 16*b* has an axial support shaft 28 the opposite ends of which are rotatably supported by suitable bearings 30 within laterally spaced upstanding walls 32*a* and 32*b* of a liquid reservoir, indicated generally at 34. A suitable spur gear 36 is keyed to an outer end of each pan roller support shaft 28 and cooperates with a drive gear 38 of a variable speed reducer drive assembly 40 to enable selective rotation of the pan rollers. The pan rollers are generally rotated at relatively low speeds such as 10–20 rpm.

Each liquid reservoir 34 includes, in addition to the upstanding end walls 32*a, b,* a bottom wall 44 and front and rear upstanding walls 46*a* and 46*b,* the upstanding end and side walls 32*a, b* and 46*a, b* being secured to the periphery of the bottom wall 44 so as to establish an open top liquid reservoir. In the illustrated embodiment, the bottom wall 44 has two runners 48 secured to its lower surface each of which has a T-shaped channel to receive a T-shaped guideway 50 affixed to a transverse support plate 52 which extends between the aforementioned upstanding frame plates. The guideways 50 facilitate selectively movement of the liquid reservoirs and associated pan rollers generally transverse or perpendicular to a vertical plane containing the axis of the transfer roll 18. Means in the form of a manually operated adjustment screw 56 is operatively associated with each of the reservoirs 34, as through a connecting bracket 58, and the transverse support plate 52 to enable movement of the pan rollers 16*a, b* relative to their corresponding transfer roll segments 18*a* and 18*b*.

The pan rollers 16*a* and 16*b,* which conventionally have rubber outer peripheral surfaces, are thus supported relative to their respective transfer rolls so as to enable movement of the pan rollers between positions establishing substantially zero clearance between the outer peripheral surfaces of the pan rollers and associated transfer rolls, and positions establishing selected spaced relation therebetween. In this manner, when a reservoir 34 is filled with liquid, such as glue, a microfragrance or a rub-off substance, sufficiently to partially submerge the associated pan roller, rotation of the pan roller serves to carry liquid upwardly on its peripheral surface and establish a metered layer or film of liquid onto the corresponding rotating transfer roll, the thickness of the film layer applied to the transfer roll being dependent on the selected rotational speed of the pan and the spatial relation established between the pan and transfer rolls. For example, in applying most glue materials to the moving paper web 12, a 0.003 inch clearance or gap between the outer peripheral surfaces of the corresponding pan and transfer rolls will form a liquid layer on the transfer roll of approximately 0.003 inch thickness, while other spatial relations may be selected for materials of different viscosities. In applying glue to the moving paper web 12, the pan roller is generally rotated at a relatively low speed of approximately 10–20 rpm. Both the spatial relation between the corresponding pan and transfer rolls and the rotational speed of the pan rolls determine the thickness of metered liquid film applied to the transfer rolls.

In the operation of the liquid applicator machine 10 as thus far described, rotational driving of any one of the pan rollers 16*a* and 16*b* causes liquid within the corresponding liquid reservoir 34 to be carried upwardly on the peripheral surface of the pan roller and metered onto the peripheral surface of the corresponding segment of the transfer roll or cylinder 18. As noted, the transfer roll is caused to rotate at a rotational speed sufficient to effect a surface speed substantially equal to the speed of the paper web passing through the applicator machine, thereby resulting in a substantially greater transfer roll rotational speed than the corresponding pan roller. As the transfer roll is caused to rotate, the film layer carried on its outer peripheral surface is engaged by a closed cell rubber pad which is supported on the outer peripheral surface of the plate cylinder 20 and may have a pattern design formed within the rubber pad. The outermost exposed surfaces of the pattern pad receive a liquid film from the transfer roll and transfer the liquid pattern to the moving paper web 12, the plate cylinder being driven at a rotational speed sufficient to effect a surface speed equal to the speed of the paper web 12 passing through the applicator machine. The aforementioned impression cylinder 22 is supported on the opposite side of the moving paper web 12 and serves to stabilize the web against the plate cylinder 20 and its associated outer rubber liquid applying pad.

It will be appreciated that as a pan roll 16*a* or 16*b* is rotated at a relatively slow speed, such as 10–20 rpm, while partially submerged within a liquid in the corresponding liquid reservoir 34, liquid will, depending upon its viscosity, adhere to and be carried upwardly by the opposite end surfaces of the pan roll as well as the outer cylindrical peripheral surface of the pan roll. In accordance with prior liquid applicator machines, the transfer roll was conventionally made of greater length than the associated pan roller such that the transfer roll extended beyond the opposite end surfaces of the associated pan roller. With this construction, continued rotation of the pan roller caused a build-up of liquid on the end surfaces of the pan roller which was carried upwardly and engaged the end extensions of the overlying transfer roll causing an accumulation of liquid at the opposite end edges of the transfer roll. Such accumulated liquid eventually caused a migration of liquid onto the opposite end surfaces of the transfer rolls which, due to their relatively high-speed rotation, caused the liquid to be slung from the transfer roll and invariably required slowing down of the liquid applicator machine and frequently resulted in breakage to the web material with attendant maintenance problems. This problem has been particularly acute in liquid applicator machines of the type illustrated in FIG. 1 which utilize a plurality of discrete transfer roll segments each of which is operatively associated with a separate liquid reservoir and associated pan roller so as to effect simultaneous application of different liquids to the moving web material. The slinging of liquids from the various transfer roll segments caused the various liquid reservoirs to be contaminated by liquid substances from other of the liquid reservoirs within the liquid applicator machine.

Figure 4:
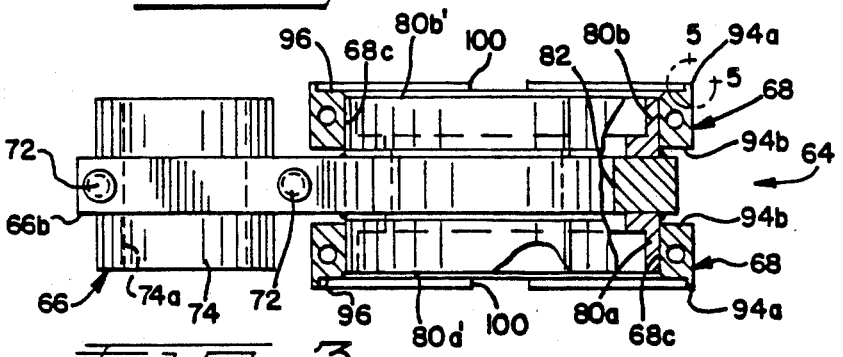
FIG. 4 is a plan view of the static ring and holder assembly of FIG. 3 but with portions broken away for clarity.
Figure 3:
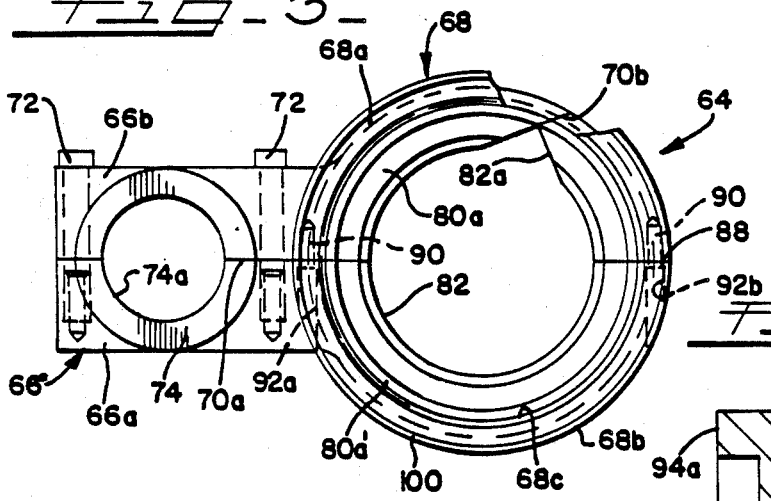
FIG. 3 is a side elevational view of a static ring and holder assembly constructed in accordance with the present invention.

In accordance with the present invention, means in the form of a static ring and holder assembly, indicated generally at 64, are operatively associated with the opposite ends of the transfer roll segments and are cooperative with the associated pan roller to prevent the accumulation of liquid at the opposite end edge surfaces of the transfer roll segments, with the result that slinging of liquid from the transfer rolls and the problems associated therewith are eliminated. With particular reference to FIGS. 1 and 2, taken in conjunction with FIGS. 3 and 4, each static ring and holder assembly 64 includes a holder member 66 which is operative to support either one or two static rings, each of which is indicated at 68. The holder member 66 has a primary parting plane 70*a* and a secondary parting plane 70*b* passing therethrough which divide the holder member into two portions 66*a* and 66*b* adapted to be releasably maintained in assembled relation through suitable screws 72. The assembled holder member 66 includes a generally annular collar 74 which defines a transverse cylindrical bore 74*a* sized to enable clamped mounting of the holder member in fixed relation on a cylindrical support rod or shaft 78 supported in fixed relation between the aforementioned upstanding frame plates parallel to the rotational axis of the transfer roll 18.

The holder member 66 has a pair of annular static ring support collars 80*a* and 80*b* formed thereon which are of equal size and are coaxial with a generally circular opening 82 formed through the holder member 66 parallel to the bore 74*a*. The peripheral surface of the opening 82 is relieved or recessed at 82*a* adjacent the parting plane 70*b* to enable assembly of the holder onto the support shaft 78 with the static ring support collars 80*a* and 80*b* extending circumferentially about reduced diameter shoulder surfaces 18'*a* and 18'*b* formed on the transfer roll 18 as illustrated in FIG. 1. The shoulder surfaces 18'*a* and 18'*b*, along with a reduced diameter portion 18*c* of the transfer roll 18, establish an axial spacing between the transfer roll segments 18*a* and 18*b*.

It will be appreciated that the holder member 66 may be mounted on the support shaft 78 between adjacent transfer roll segments, such as 18*a* and 18*b*, or alternatively outwardly of either of the extreme opposite ends of the transfer roll 18 for supporting a single static ring 68.

Each static ring 68 comprises an annular ring member made of a metallic material such as bronze and has a substantially rectangular transverse cross section. The static ring is preferably made in two half sections 68*a* and 68*b* which are divided by a parting plane 88 and are maintained in releasable assembled relation by suitable screws 90 received within counterbores 92*a* and 92*b* formed in the ring section 68*b*. The static ring 68 has outwardly facing planar surfaces 94*a* and 94*b* which lie perpendicular to the center axis of the annular internal surface 68*c*. The planar surface 94*a* defines an annular sealing surface which is positioned in oppositely facing relation to an annular end surface of a transfer roll segment, such as indicated at 18'*d* and 18'*e* on the transfer roll segments 18*a* and 18*b* in FIG. 1. The width of the static ring 68, considered as the distance between the planar surfaces 94*a* and 94*b*, is greater than the outer extension of the static ring support collars 80*a* and 80*b* on the holder member 66 so that the sealing surface 94*a* is spaced outwardly from the annular edge surfaces 80'*a* and 80'*b* of the ring support collars when having static rings mounted therein. The internal annular surface 68*c* of the static ring 68 is sized to enable selective clamped mounting on either of the support collars 80*a,b*.

Figure 5:
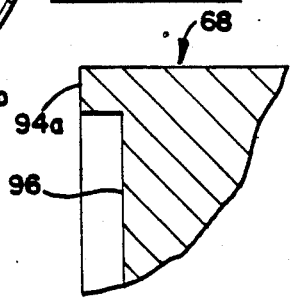
FIG. 5 is an enlarged fragmentary detail view of the static ring as encircled by line 5—5 in FIG. 4.

Referring to FIG. 5, the annular sealing surface 94*a* on the static ring 68 is of limited radial extent so as to minimize frictional heat that may be established during the operation of the liquid applicator machine. This is particularly important when applying a heat setting glue to the web. To this end, the sealing surface 94*a* preferably has a radial dimension of approximately 1/16 inch established by a circular recess 96 formed in the face of the static ring corresponding to the sealing surface 94*a*. A drainage channel or recess 100 is formed in a selected one of the static ring portions 68*a* or 68*b* so as to extend through the sealing surface 94*a* and provide a channel through which liquid may pass which enters or migrates between an annular end surface on a transfer roll segment, such as 18'*d* and 18'*e*, and the associated sealing surface 94*a* of an associated static ring. In mounting a static ring 68 on an associated holder member 68, the static ring is preferably oriented such that the drainage recess or channel 100 is located at the lowermost point to facilitate drainage.

In accordance with the present invention, a static ring 66 is supported coaxially with and closely spaced to an annular end surface on each end of a transfer roll segment. With particular reference to FIG. 1, a pair of static rings 68 are supported between adjacent ends of the transfer roll segments 18*a* and 18*b* such that their limited area annular sealing surfaces 94*a* are spaced a predetermined distance from the annular end surfaces 18'*b* and 18'*e* formed on the transfer roll segments 18*a* and 18*b*, respectively. When applying most types of glue to a moving web 12, a clearance between the sealing surfaces 94*a* of the static rings and the opposite annular end surfaces of the transfer roll segments is preferably maintained at approximately 0.010 inch clearance. If a microfragrance substance is being applied to the moving web, a clearance of approximately 0.005 may be desirable. If a rub-off substance is being applied to the web material (such as utilized to temporarily obscure printed indicia on the web material), a clearance of approximately 0.020 inch may be desirable. The clearance established between the sealing surfaces 94*a* of the static rings and the opposed annular end surfaces of the transfer rolls is sufficient to substantially prevent fluid from migrating between the end surfaces of the transfer roll segments and the static rings.

In accordance with the present invention, the length of each pan roller 16 is made longer than the associated high speed transfer roll so as to extend beyond the opposite ends of the associated transfer roll in overlapping relation with the outer annular surfaces of the corresponding static rings. For example, when the fluid being transferred to the moving web dictates a clearance of approximately 0.003 inches between the pan roller and associated transfer roll, the pan roller is preferably made of sufficient length to provide approximately 0.25 inch overlap with each of the associated static rings 68.

Depending upon the viscosity of the fluid being transferred to the moving web, a clearance between the outer annular surface of each static ring 68 and the associated pan roller is established which is substantially equal to the clearance between the annular planar sealing surface 94*a* of the static ring and the opposing end surface of the transfer roll. Thus, if a clearance of approximately 0.010 inch is desired between the sealing face of a static ring and the end surface on the adjacent transfer roll, a similar clearance of approximately 0.010 is preferably provided between the outer annular surface of the static ring and the pan roll. To effect such clearance, the outer annular surface of the static ring is formed with a diameter slightly less than the diameter of the associated transfer roll.

In operation, fluid carried upwardly by the end surfaces on a pan roll either cascades down upon itself or engages the outer annular surface of the associated static ring and drops downwardly into the associated liquid reservoir. In this manner, accumulation of liquid on the opposite end edges of the associated transfer roll is substantially eliminated and thus flinging of liquid from the transfer roll as has heretofore been experienced.

It will be appreciated that where a single uniform diameter transfer roll is employed in a liquid applicator machine, a pair of static ring and holder assemblies 64 will be employed at the opposite ends of the transfer roll and a single or unitary pan roller will be made of sufficiently greater length than the corresponding transfer roll to overlap the associated static rings in the aforedescribed manner, thus preventing accumulation of liquid at the opposite end edges of the high-speed transfer roll and eliminating flinging of liquid therefrom.

Figure 6:
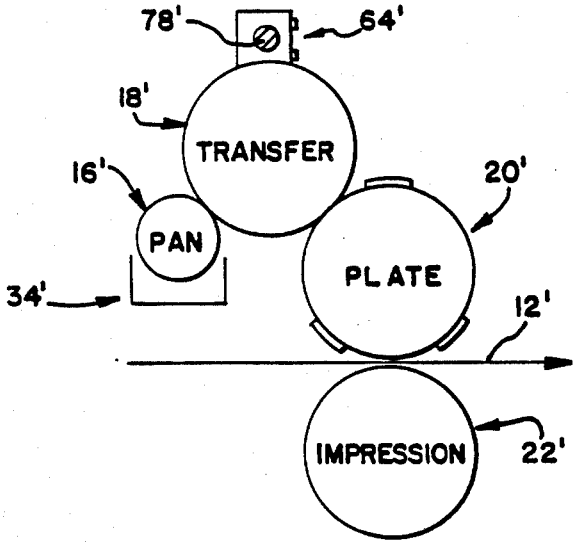
FIG. 6 is a schematic diagram of a liquid applicator machine of the type for applying liquid to the upper surface of a moving web and with which the present invention may be employed.

FIG. 6 diagrammatically illustrates an alternative arrangement for positioning the various rolls and cylinders in a machine for applying liquid, such as glue, to a moving web 12' so as to apply the liquid to an upper surface of the moving web. Very generally, a pan roll 16' is operative to pick up a liquid on its outer peripheral surface from a reservoir 34' and transfer a metered layer of the liquid onto a high-speel transfer roll 18' similar to the aforedescribed transfer roll 18. The transfer roll 18' is operative to apply liquid to outer exposed surfaces of applicator pads carried on a plate roll or cylinder 20' which, during rotation, cooperates with an impression roll 22' to apply liquid to the upper surface of the paper web 12'. One or more static ring and holder assemblies, one of which is indicated at 64', are operatively associated with the transfer roll 18' and pan roll 16' to prevent slinging of liquid from the high-speed transfer roll in similar fashion to the aforedescribed liquid applicator machine 10.

Thus, in accordance with the present invention, a unique method and apparatus are provided for preventing flinging of liquid from a high speed rotating transfer roll within a liquid applicator machine with resulting greater efficiency and substantial economic savings through significant reduction in maintenance problems and downtime of the applicator machine as have heretofore been experienced.

While preferred embodiments of the present invention have been described, it will be understood that changes and modifications may be made therein without departing from the invention in its broader aspects. Various features of the invention are defined in the following claims.

What is claimed is:

1. In a liquid applicator machine for applying a liquid to a moving web, said machine including a liquid reservoir, a pan roll having opposite end surfaces and being cooperative with the liquid reservoir so as to pick up liquid on the outer peripheral surface of the pan roll during rotation thereof, and a high speed transfer roll having opposite end edge surfaces and being cooperative with the pan roll so as to apply a metered liquid layer to the outer peripheral surface of the transfer roll during rotation of said rolls; the combination therewith comprising a static ring member supported in substantially coaxial predetermined spaced relation to each of the opposite end edge surfaces of the transfer roll, each of said ring members having an outer peripheral surface substantially coterminous with the outer peripheral surface of the transfer roll, said pan roll having a length greater than the length of said transfer roll so that opposite ends of said pan roll overlap the outer peripheral surfaces of said static ring members in juxtaposed relation therewith, said pan roll being cooperative with said static ring members such that liquid carried on the end surfaces of the pan roll tending to transfer to said transfer roll engages the corresponding static ring members and is prevented from accumulating at the opposite end edge surfaces of the transfer roll and being flung therefrom.

2. In a machine for transferring a liquid from the outer peripheral surface of a first carrier roll to the outer peripheral surface of a higher speed second roll, and wherein the first roll has opposite end surfaces and is adapted to receive and carry a liquid on its outer peripheral surface during rotation thereof, and the second higher speed roll has opposite end edge surfaces and is cooperative with the first roll so as to apply a metered liquid layer to the outer peripheral surface of the second roll during rotation of said rolls; the combination therewith comprising at least one static ring member supported in substantially coaxial predetermined spaced relation to a selected one of the opposite end edge surfaces of the second roll and having an outer peripheral surface substantially coextensive with the outer peripheral surface of the second roll, said first roll having an end extending beyond said selected end of said second roll so as to overlap the outer peripheral surface of said static ring member in juxtaposed relation therewith, said extending end of said first roll being cooperative with said static ring member such that liquid carried on the corresponding end surface of the first roll which tends to migrate onto the corresponding end of said second roll engages the outer peripheral surface of said static ring member and is prevented from accumulating on the corresponding end edge of said second roll and being flung therefrom.

3. A liquid transfer machine as defined in claim 2 wherein the outer peripheral surface of said second roll is cylindrical, said outer peripheral surface of said ring member being cylindrical and of a diameter approximately equal to the diameter of said second roll.

4. A liquid transfer machine as defined in claim 2 including a second of said static ring members supported in substantially coaxial predetermined spaced relation to the opposite end edge surface of said second roll, said first roll having a length greater than the length of said second roll so that opposite ends of said first roll overlap the outer peripheral surfaces of said ring members in juxtaposed relation such that liquid tending to accumulate at each end edge surface of said second roll passes onto the outer peripheral surface of the corresponding ring member.

5. A liquid transfer machine as defined in claim 4 wherein each of said static ring members has an annular planar sealing surface, said static ring members being supported such that said sealing surfaces are in predetermined spaced relation to the corresponding end edge surfaces on said second roll.

6. A liquid transfer machine as defined in claim 5 wherein said annular planar sealing surfaces are of limited radial extent so as to minimize frictional heat during operation of said machine.

7. A liquid transfer machine as defined in claim 4 including a holder member operatively associated with each of said static ring members, said holder members and static ring members being configured to enable mounting on a support shaft spaced from the rotational axis of said second roll.

8. A liquid transfer machine as defined in claim 7 wherein each of said holder members includes means enabling mounting of a pair of static ring members thereon in axially aligned relation.

9. A liquid transfer machine as defined in claim 8 wherein each of said holder members and its associated static ring members are configured to enable mounting about a reduced diameter shaft intermediate larger diameter roll segments with each static ring member being in coaxial predetermined spaced relation to an end surface on an associated one of said larger diameter roll segments.

10. A liquid transfer machine as defined in claim 7 wherein each of said static ring members and its associated holder member are cooperative to enable adjustment of said static ring members relative to the corresponding end edge surfaces of said second roll.

11. A liquid transfer machine as defined in claim 2 including a holder member operatively associated with said static ring member in a manner to support said ring member in said coaxial predetermined spaced relation to said second roll.

12. A liquid transfer machine as defined in claim 9 wherein said holder member includes a parting plane enabling manipulation for mounting about said reduced diameter shaft, said static ring members each comprising a pair of ring segments enabling mounting on said holder member after said holder member is mounted about said reduced diameter shaft.

13. A liquid transfer machine as defined in claim 2 wherein said static ring member has a planar sealing surface disposed in opposed predetermined spaced relation to said selected end edge surface of said second roll, said sealing surface having a drain channel formed therein to facilitate drainage of liquid which may enter said predetermined space.

14. A method for preventing accumulation of liquid at an end edge of a first generally cylindrical rotating roll having opposite end edges and disposed parallel to and spaced a predetermined distance from a second generally cylindrical rotating roll operative to transfer to the outer peripheral surface of the first roll liquid carried on the outer peripheral surface of the second roll so as to form a metered liquid layer on the first roll during rotation of the first and second rolls, and wherein the first roll is rotatable at a speed which may cause liquid accumulated at said end edges to be slung off, said method comprising the steps of establishing a stationary surface in substantially coextensive relation to the outer cylindrical surface of said end edge of said first roll and in predetermined spaced relation to said end edge, and positioning said second roll such that an end edge thereof extends beyond said end edge of said first roll in juxtaposed relation to said stationary surface so that said second roll and said stationary surface cooperate to prevent liquid from accumulating at said end edge of said first roll and thereby prevent slinging of liquid from said end edge of said first roll during rotation thereof.

15. The method as defined in claim 14 wherein said step of establishing said stationary surface comprises supporting a static ring member in coaxial predetermined spaced relation to said end edge of said first roll, said static ring member having an outer cylindrical peripheral surface of a diameter approximately equal to the diameter of the first roll such that liquid carried by said end edge of said second roll which tends to migrate to said first roll is deposited onto said outer cylindrical surface of said static ring and is thereby prevented from being slung from said first roll during rotation thereof.

16. The method as defined in claim 15 wherein said static ring member includes a planar annular sealing surface lying in a plane transverse to the axis of its outer cylindrical surface, and including the step of positioning said static ring member such that said sealing surface lies in parallel predetermined spaced relation to said end edge of said first roll.

17. The method as defined in claim 16 wherein said static ring member is formed of a diameter sufficient to create a space between its annular peripheral surface and the outer surface of the corresponding end of said second roll which is substantially equal to the space between said planar sealing surface and said corresponding end edge of said first roll.

18. The method as defined in claim 15 including the step of positioning one of said static ring members in coaxial predetermined spaced relation to each of the opposite end edges of said first roll, and forming said second roll of a length such that opposite end edges thereof extend longitudinally outwardly from the corresponding end edges of said first roll in predetermined juxtaposed relation to the outer peripheral surfaces on the corresponding static ring members.

19. The method as defined in claim 15 wherein said first roll is formed with a plurality of axially aligned interconnected substantially cylindrical segments each of which has opposite end edges and is associated with a discrete second roll operative to transfer a liquid to the outer peripheral surface of the corresponding segment of said first roll so as to form a metered layer of liquid thereon, said method including positioning one of said static ring members in coaxial relation with each of the opposite end edges of each segment of said first roll such that the planar sealing surface of each static ring member is in predetermined spaced relation to the corresponding segment end edge, and forming each of said discrete second rolls such that opposite end edges thereof extend beyond the end edges of the corresponding segment of said first roll in juxtaposed relation to the peripheral surfaces of the associated static ring members such that liquid carried by said end edges of said second rolls migrates onto the outer peripheral surface of the corresponding static ring members and is prevented from outward slinging from said first roll.

20. A static ring assembly for use with a roll rotatable about its longitudinal axis and having an outer peripheral surface and at least one generally planar end surface, said ring assembly including an annular static ring member having an outer peripheral surface of substantially similar size and configuration to the outer peripheral surface of said roll, said ring member defining an annular sealing surface, and a holder member having a first portion operative to support said ring member and having a second portion enabling mounting of said holder member on a support shaft spaced from the rotational axis of said roll such that said ring member is disposed in stationary coaxial relation with said roll and said annular sealing surface is spaced a predetermined distance from said planar end surface on said roll so as to prevent liquid on the outer peripheral surface of said roll from migrating onto said end surface thereof.

21. A static ring assembly as defined in claim 20 wherein said outer peripheral surface on said roll is cylindrical, said outer peripheral surface on said ring member being cylindrical and of a diameter generally similar to the diameter of said roll, said annular sealing surface on said ring member forming an end boundary of said cylindrical outer peripheral surface thereof.

22. A static ring assembly as defined in claim 21 wherein said holder member includes a pair of axially aligned support collars each of which is adapted to support one of said annular ring members thereon.

23. A static ring assembly as defined in claim 21 wherein said holder member has a parting plane therethrough defining two holder member sections which may be separated to facilitate mounting of said holder member on said support shaft.

24. A static ring assembly as defined in claim 23 wherein said ring member comprises a split ring separable into two segments enabling mounting on and release from said holder member.

* * * * *